US005854530A

United States Patent [19]

LaForest et al.

[11] Patent Number: 5,854,530

[45] Date of Patent: Dec. 29, 1998

[54] PIEZOELECTRIC LIGHTER WHICH HAS A HIGHER LEVEL OF DIFFICULTY FOR OPERATION

[75] Inventors: Guy LaForest, Cascais, Portugal; Marcel Meury, Tarragona, Spain

[73] Assignee: BIC Corporation, Milford, Conn.

[21] Appl. No.: 768,545

[22] Filed: Dec. 18, 1996

[51] Int. Cl.[6] ..... H01L 41/08

[52] U.S. Cl. ..... 310/339; 310/328; 310/319; 361/260; 431/255

[58] Field of Search ..... 361/247, 260; 310/339, 340, 338; 313/234, 571, 572; 315/248, 209 PZ; 431/256, 131, 132, 255

[56] References Cited

U.S. PATENT DOCUMENTS

| | | | |
|---|---|---|---|
| 3,457,461 | 7/1969 | Steinke et al. | 317/81 |
| 3,486,075 | 12/1969 | Steinke et al. | 317/81 |
| 3,521,987 | 7/1970 | Goto | 431/255 |
| 3,729,639 | 4/1973 | Heinouchi et al. | 310/8.3 |
| 3,829,737 | 8/1974 | Johnsson | 317/81 |
| 3,866,069 | 2/1975 | Ishii et al. | 310/8.7 |
| 3,949,248 | 4/1976 | Duffner et al. | 310/8.7 |
| 3,984,738 | 10/1976 | Mohr | 371/81 |
| 4,015,152 | 3/1977 | Mohr | 310/8.7 |
| 4,139,792 | 2/1979 | Kondo | 310/339 |
| 4,315,180 | 2/1982 | Kondo et al. | 310/319 |
| 4,422,124 | 12/1983 | Challet | 361/260 |
| 4,608,508 | 8/1986 | Ohnishi | 310/339 |
| 4,786,248 | 11/1988 | Nitta | 431/255 |
| 4,859,172 | 8/1989 | Nitta | 431/153 |
| 4,904,180 | 2/1990 | Nitta | 431/153 |
| 5,059,852 | 10/1991 | Meury | 310/339 |
| 5,145,358 | 9/1992 | Shike et al. | 431/153 |
| 5,178,532 | 1/1993 | Frigiere | 431/254 |
| 5,228,849 | 7/1993 | Frigiere | 431/255 |
| 5,240,408 | 8/1993 | Kenjiro et al. | 431/153 |
| 5,262,697 | 11/1993 | Meury | 310/339 |
| 5,462,432 | 10/1995 | Kim | 431/153 |

FOREIGN PATENT DOCUMENTS

| | | | |
|---|---|---|---|
| 0 172 973 | 3/1986 | European Pat. Off. . | |
| 0 488 158 | 6/1993 | European Pat. Off. . | |
| 0 689 011 | 12/1995 | European Pat. Off. . | |
| 222927 | 12/1974 | France . | |
| 8902741 | 2/1989 | Spain . | |
| 2014189 | 6/1990 | Spain . | |
| 2026089 | 4/1992 | Spain . | |
| 2032187 | 1/1993 | Spain . | |
| 2046964 | 2/1994 | Spain . | |
| 2 072 820 | of 0000 | United Kingdom . | |
| 1 218 207 | 2/1968 | United Kingdom | 310/339 |
| 1415003 | 11/1975 | United Kingdom . | |

*Primary Examiner*—Mark O. Budd
*Assistant Examiner*—Timothy A. Williams
*Attorney, Agent, or Firm*—Pennie & Edmonds LLP

[57] ABSTRACT

The piezoelectric ignition mechanism of the present invention has a telescopic assembly having an inner and an outer members aided by a return spring for maintaining a maximum extension between the members. The inner member includes a piezoelectric element which is immobilized between an anvil and impact pad over which a plexor strikes to generate a spark. An impact spring for aiding the plexor is guided in the interior of the telescopic assembly and is disposed between the plexor and an end member connected to the outer telescopic member. A resistant spring is also disposed at or near the end member to provide additional resistance to the operation of the piezoelectric mechanism in order to discourage the undesirable operation by young users.

21 Claims, 6 Drawing Sheets

PIEZOELECTRIC LIGHTER WHICH HAS A HIGHER LEVEL OF DIFFICULTY FOR OPERATION

BACKGROUND OF THE INVENTION

1. Technical Field

The present invention relates to a piezoelectric ignition mechanism, which includes a mechanism for resisting ignition by young users.

2. Background Art

A typical piezoelectric ignition mechanism is formed by a telescopic assembly having an inner member and an outer member that are separated by a return spring which maintains them in a position of maximum extension. Fixed to one of these members is a crystal or piezoelectric element, which provides a lighting spark when impacted by a plexor. The piezoelectric element, in turn, is placed between a metallic head, called an "anvil", and another member which actually receives the impact of the plexor, called an "impact pad".

The plexor is slideably received in the axial void inside of the telescopic body, and in a rest position is kept distant from the piezoelectric element due to the presence of a retaining mechanism. The plexor's movement is guided by a pair of opposite longitudinal slots defined on the wall of one of the telescopic members, each one of the slots retaining a lug formed on the plexor.

The plexor is resiliently biased by an impact spring toward the impact pad, said spring is partially or totally guided within the interior of the telescopic member that houses the plexor. The impact spring is supported at the other end by an end cap that is affixed to the open end of the telescopic assembly. This end cap is provided with hooks, which are received in corresponding lateral windows on opposite facing walls of the telescopic assembly. The cap is thus retained in this fixed position.

To produce a spark, a manual compressive force is applied to the telescopic assembly causing the inner and outer telescopic members to move toward each other. This action also compresses the return spring which separates the inner and outer members, and simultaneously compresses the impact spring to store energy therein. Towards the end of the contraction of the telescopic assembly, the plexor is released from the retaining mechanism and the compressed impact spring drives the plexor toward the impact pad, imparting the impact energy to generate an electrical potential or voltage across the piezoelectric element. Said potential is conducted through other conductive elements in the cigarette lighter, which make up an electrical circuit. This circuit has an open gap located near the valve where the fuel from a fuel supply is released. Said potential creates a spark across the gap and ignites the released fuel to create a flame. An example of such piezoelectric mechanism is disclosed in U.S. Pat. No. 5,262,697 entitled "Piezoelectric Mechanism For Gas Lighters". The disclosure of the '697 patent is hereby incorporated by reference.

It is desirable to increase the difficulty of using lighters to limit the ability of young children under five years of age to operate such piezoelectric lighters. For this reason, there have been attempts to provide "child-resistant" piezoelectric lighters offered in the patent literature. Examples of such patents include U.S. Pat. Nos. 5,145,358, 5,240,408, 4,904,180, 4,859,172, 4,786,248 and 5,228,849. Each of these disclosed devices has in common the fact that depression of the thumb pad, which compresses the telescopic assembly to activate the piezoelectric mechanism and release lever, is prevented from compression by a latch member which inhibits the production of sparks and release of fuel. Normally, the latch member is disposed between the thumb pad and a wall of the lighter body. This latch member must be aligned or positioned precisely between the thumb pad and the lighter body's wall in order to prevent the depression of the thumb pad.

Thus, there remains a need for a device, which limits the ability of young children to operate a piezoelectric ignition mechanism, and which would not require the use of a latch member.

SUMMARY OF THE INVENTION

Thus, it is an object of this invention to provide a lighter which limits the ability of unintended users to operate the lighter.

Another object of the invention is to provide a piezoelectric ignition mechanism which resists the production of sparks by unintended users, but does not require the use of a latch member.

Another object of the invention is to provide a piezoelectric lighter which requires a more forceful and purposeful depression of the thumb pad, which activates the piezoelectric mechanism.

These and other objectives can be achieved by a piezoelectric ignition mechanism comprising a telescopic assembly having an inner and outer members normally separated by a return spring, a piezoelectric element positioned inside the telescopic assembly, preferably inside the inner member, and a plexor movably disposed in the inner member. The plexor is resiliently biased toward the piezoelectric element by an impact spring, said impact spring is positioned between the plexor and an end member of the telescopic assembly. The plexor is normally positioned opposite the piezoelectric element, and is normally retained at a predetermined distance away from the piezoelectric element, such that when the plexor is released, it impacts against the piezoelectric element to produce a spark.

The ignition mechanism further comprises a resistant spring disposed within the telescopic assembly, such that it resists the continuing movement of the assembly to release the plexor. To produce a spark, the user compresses the telescopic assembly by depressing the inner member into the outer member. This action compresses the impact spring to store energy therein, and to release the plexor to allow the compressed impact spring to drive the plexor to impact against the piezoelectric element. However, prior to the release of the plexor, the user first at least partially compresses the resistant spring. The stiffness of the resistant spring can be selected to provide a desirable resistant force against the unwanted ignition of the piezoelectric mechanism by unintended users.

BRIEF DESCRIPTION OF THE DRAWINGS

To facilitate the understanding of the characteristics of the invention, the following drawings have been provided, wherein.

DESCRIPTION OF THE PREFERRED EMBODIMENTS

Figure 1:
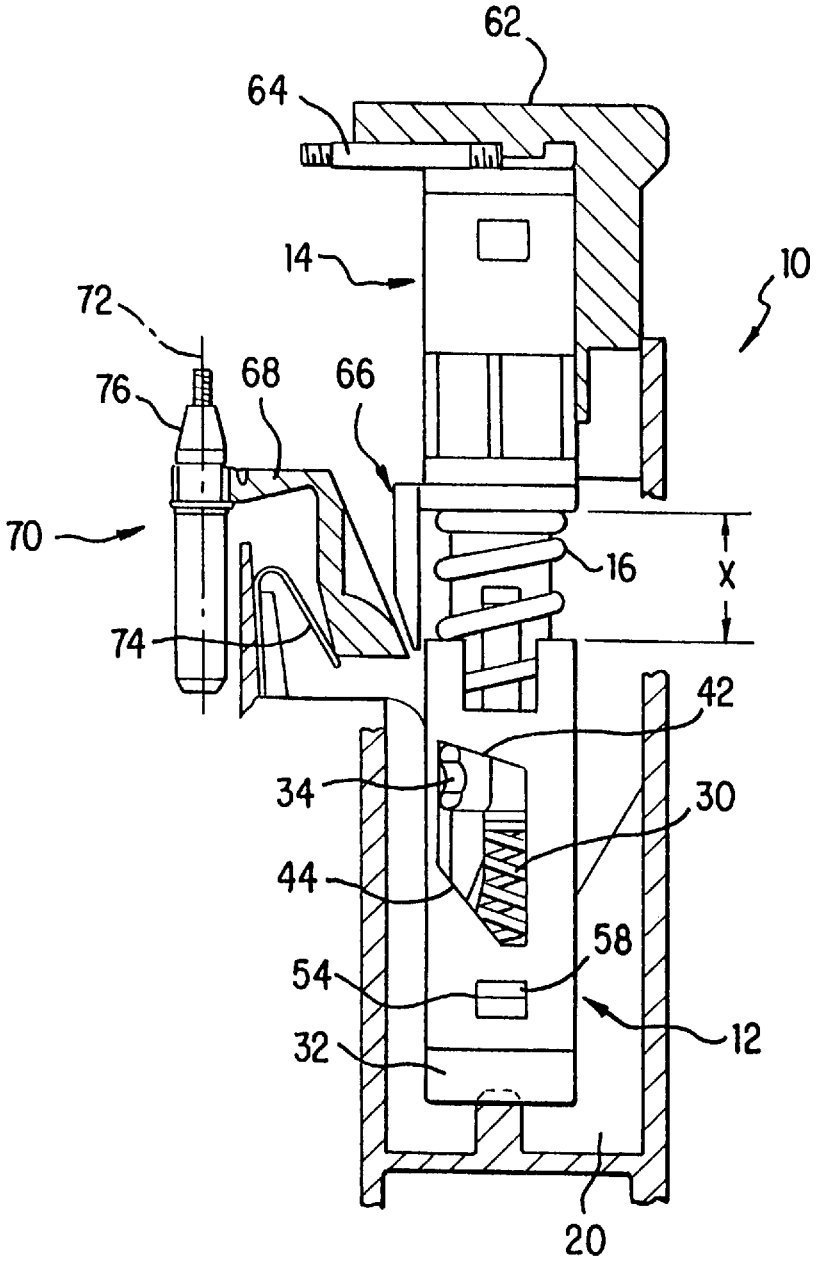
FIG. 1 is a front longitudinal view, in partial cross section, of the piezoelectric mechanism of the present invention in the rest or normal configuration, in an assembled position and located in a gas lighter assembly.

Referring to the drawings, wherein like reference numbers are used to designate like parts, and as shown in FIG. 1, piezoelectric ignition mechanism 10 of a lighter according to the present invention, shown in the rest or normal configuration, comprises first and second telescopic members, which include an outer telescopic member 12, and inner telescopic member 14. Return spring 16 is positioned between the outer assembly 12 and the inner assembly 14 to maintain a separation denoted by X between the two members. Piezoelectric mechanism 10 is disposed in a chamber 20 located in a body of a lighter, and is isolated from the fuel source, e.g., compressed hydrocarbon gas.

Figure 3:
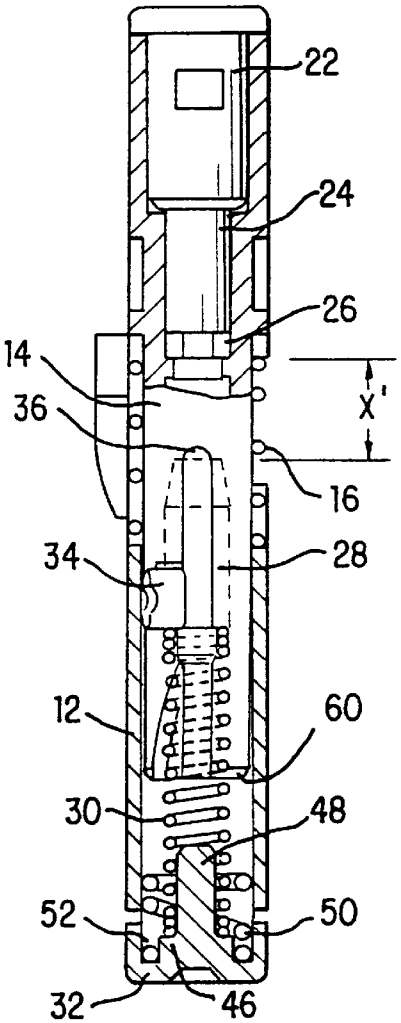
FIG. 3 is a partial cross-sectional view of the piezoelectric mechanism of FIG. 2.
Figure 2:
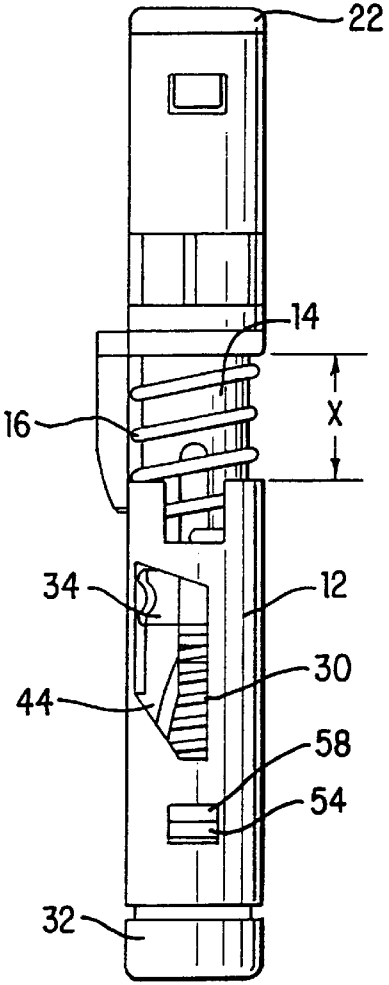
FIG. 2 is a front longitudinal view of the piezoelectric mechanism shown in FIG. 1.
Figure 6:
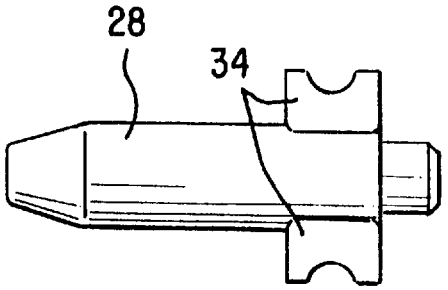
FIGS. 6 and 7 are front and side views of the plexor element.
Figure 7:
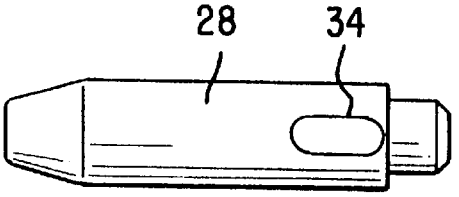

As also shown in FIGS. 2 and 3, piezoelectric mechanism 10 comprises anvil member 22, piezoelectric element 24 and impact pad 26. Plexor member 28, shown in phantom, in FIG. 3 and also in FIGS. 6 and 7, is guided within inner telescopic member 14. Plexor 28 is resiliently biased toward impact pad 26 by impact spring 30, which is also disposed in inner member 14. Outer member 12 also has end member 32 affixed thereon.

Figure 4:
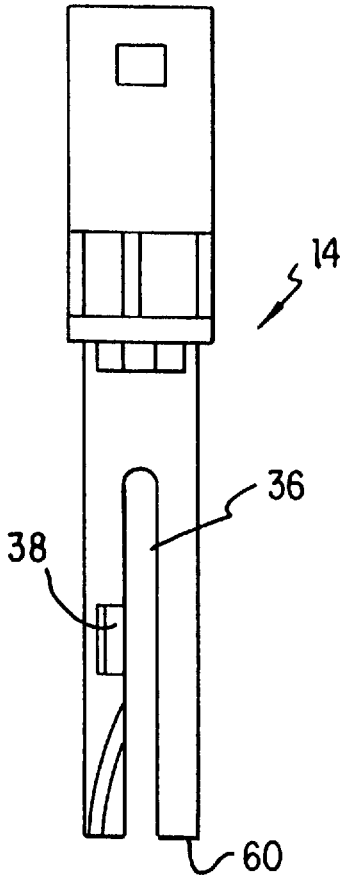
FIG. 4 is a front view of the inner telescopic member of the mechanism of FIG. 1.
Figure 5:
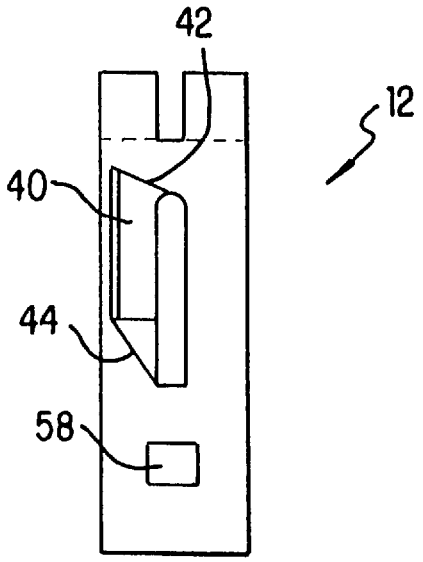
FIG. 5 is a front view of the outer telescopic member of FIG. 3.

Plexor 28 has two lugs 34 formed on opposite sides thereof. Lugs 34 are received in longitudinal slots 36, which are defined on opposite sides of inner member 14 as shown in FIG. 4. Longitudinal slots 36 guide the displacement of plexor 28, limiting it to the longitudinal direction. Each longitudinal slot 36 has retaining notch 38. Lugs 34 are configured and dimensioned to protrude beyond slots 36 and into windows 40, which are defined on opposite sides of outer member 12 as shown in FIGS. 1 and 5. Window 40 also has an upper ramp surface 42 and lower ramp surface 44. Thus, the displacement and movement of lugs 34 is controlled by slots 36, notches 38 and ramp surfaces 42 and 44.

In the normal or rest configuration shown in FIGS. 2 and 3, lugs 34 of plexor member 28 are being held in notches 38 of longitudinal slots 36 on the inner assembly member 14, and plexor 28 is retained at a predetermined distance X' away from impact pad 26. Plexor member 28 is being resiliently pushed toward impact pad 26 by impact spring 30 as shown in FIGS. 2 and 3. The bottom end of impact spring 30 abuts against ledge 46 of end member 32. The bottom end of impact spring 30 is also received by boss 48 to assist in the positioning of impact spring 30.

Figure 8:
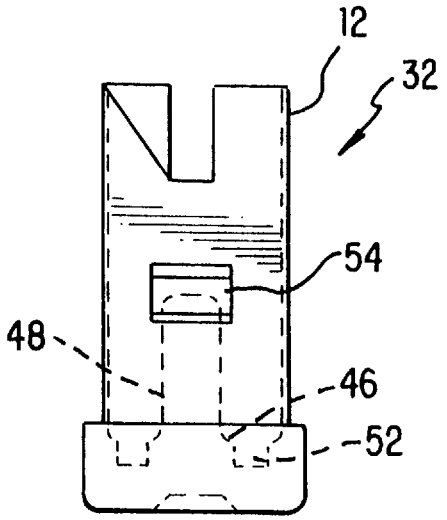
FIGS. 8, 9, and 10 are respective front (shown partially in phantom), side and top views of an end cap for the outer telescopic member.
Figure 9:
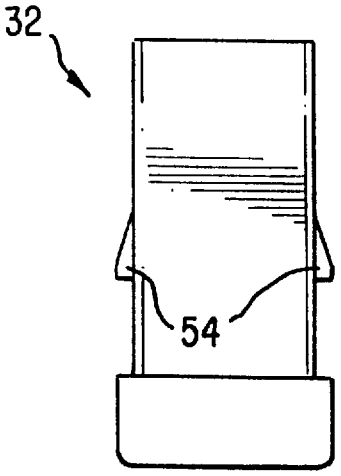
Figure 10:
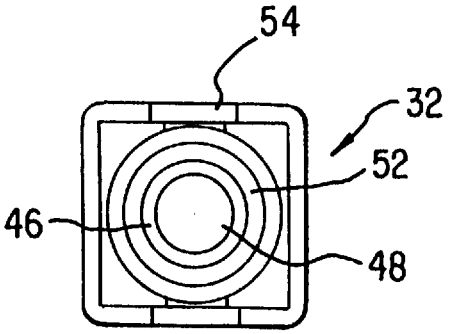

Also disposed within end member 32 and concentric with impact spring 30 is resistant spring 50, which is positioned within channel 52 located on the bottom of end-member 32 as shown in FIG. 3 and more particularly in FIGS. 8 and 10. Referring to FIGS. 8 and 9, end member 32 also has hooks 54 disposed on opposite sides thereof. Hooks 54 engage with openings 58 on outer telescopic member 12 to retain end member 32 in outer member 12. In the rest configuration depicted in FIG. 3, resistant spring 50 is preferably not in physical contact with inner member 14.

Figure 12:
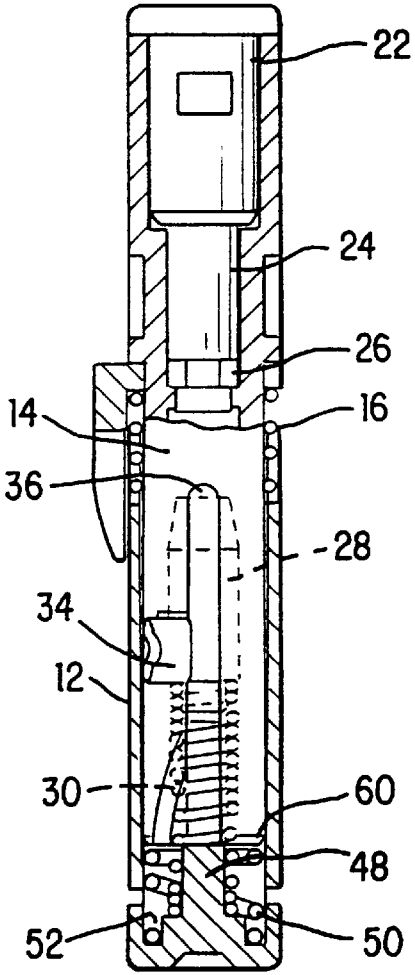
FIG. 12 is a partial cross-sectional view of FIG. 11.
Figure 11:
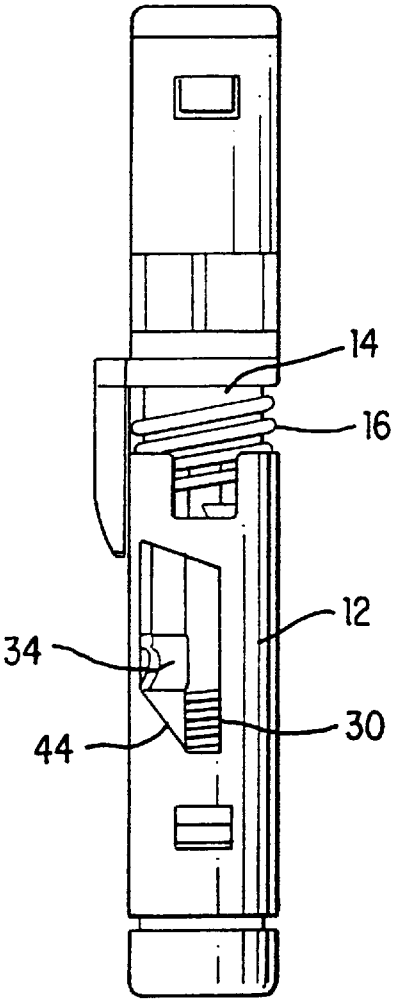
FIG. 11 is a front longitudinal view of the piezoelectric mechanism of FIG. 2 showing partial compression of the impact spring and no compression of the resistant spring.

In order to generate a spark, a user normally depresses or pushes inner telescopic member 14 downward and into outer telescopic assembly 12 thereby compressing return spring 16 and impact spring 30. As the inner telescopic assembly is being pushed downward, lugs 34 of plexor member 28 slide downward until it reaches the top of ramp surface 44, as depicted in FIG. 11. In a preferred embodiment, at or near this configuration, the bottom 60 (as depicted in FIGS. 3 and 12) of inner telescopic member 14 comes into contact with resistant spring 50 (as shown in FIG. 12).

Figure 13:
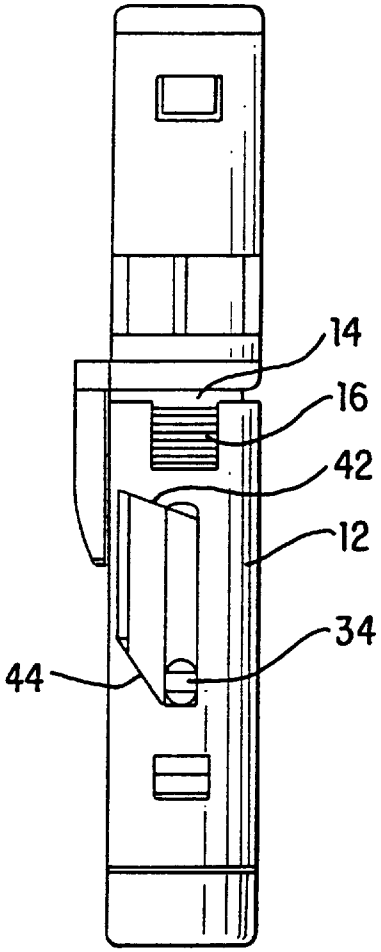
FIG. 13 is a front longitudinal view of the piezoelectric mechanism of FIG. 2 showing full compression of the impact spring just before impact, and of the resistant spring.

Without the resistant spring 50, the continuing depression of inner telescopic member 14 compresses impact spring 30 and pushes lugs 34 of plexor member 28 downward along ramp surface 44 until lugs 34 are released from notches 38 (for example, see FIG. 13). After lugs 34 are released, plexor member 28 is immediately driven by compressed impact spring 30 toward impact pad 26 and strikes impact pad 26 to transfer the energy stored in impact spring 30 to piezoelectric element 24, to thereby excite piezoelectric element 24 to create an electrical potential across same.

Figure 14:
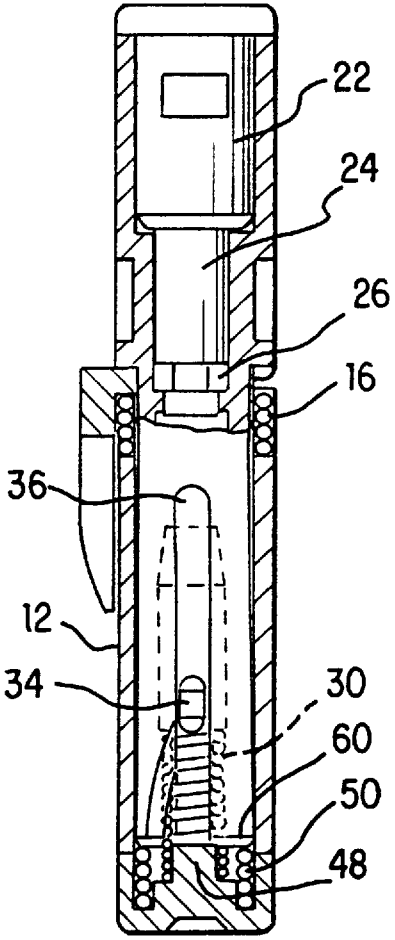
FIG. 14 is a partial cross-sectional view of FIG. 13.

However, with the presence of resistant spring 50 when bottom 60 of inner telescopic member 14 comes into contact with resistant spring 50, the amount of force required to continue to depress inner telescopic member 14 is suddenly increased. In other words, to continue to depress inner telescopic member 14, the user must overcome the continuing resistance of impact spring 30, as well as the additional resistance from resistant spring 50. Resistant spring 50 is preferably dimensioned and configured so that the user has to at least partially depress spring 50 in order to release lugs 34 from notches 38. Spring 50 can also be advantageously configured and dimensioned so that an adult user can overcome its resistant force while its resistant force may resist compression by a child user. If the user is able to at least partially compress resistant spring 50, then lugs 34 can be moved from the top of ramp surface 44, shown in FIG. 11, to the bottom of ramp surface 44, shown in FIGS. 13 and 14, so that lugs 34 are released from notches 38 and are once again aligned within longitudinal slot 36, and in the meantime impact spring 30 is being further compressed by the movement of lugs 34 along ramp surface 44. Immediately after the release of lugs 34, compressed impact spring 30, with the aid of compressed resistant spring 50 drives plexor 28 toward the impact pad and strikes same.

After the impact pad 26 has been struck by plexor 28, the user can simply release the thumb pad 62 (shown in FIG. 1), thereby allowing the compressed return spring 16 to once again separate the inner and outer telescopic members from each other, until ramp surfaces 42 aligns with notches 38. Due to the generally upward slope of ramp surface 42, shown in FIG. 5, lugs 34 of plexor 28 is pushed by impact spring 30 along ramp 42 until lugs 34 are deposited into notches 38, such that lugs 34 and plexor 28 are retained in notches 38. This is the rest or normal configuration depicted in FIGS. 1, 2 and 3.

Thus, the piezoelectric mechanism of the present invention presents a desirable high threshold level of force required for operation without requiring the use of a latch member.

Referring to FIG. 1, after plexor 28 strikes impact pad 26, which transfers the impact energy to the piezoelectric element 24, an electrical potential difference is created across piezoelectric element 24. Piezoelectric member 24 is one element in an electrical circuit comprising first electrode 64, anvil 22, piezoelectric member 24, impact pad 26, cam member 66, valve actuator 68, valve system 70 and second electrode 72. Thus, the potential difference across piezoelectric element 24 is conducted through this circuit, and creates substantially the same potential difference between first electrode 64 and second electrode 72. This potential difference is sufficient to discharge a spark across the air gap between the two electrodes. In other words, the two electrodes act similar to a capacitor with air dielectric disposed therebetween. Any electrically conductive material may be utilized to make the components of this circuit. A person of ordinary skill in the art may select suitable materials for the various components in this circuit.

When thumb pad 62 is depressed to create the spark, cam member 66 is also depressed, and acts on valve actuator 68. Actuator 68 is pivoted such that when cam member 66 pushes one end of actuator downward, the other end is moved upward thereby lifting valve system 70 to release fuel gas. The released gas is then ignited by the spark discharged between electrodes 64 and 72.

Valve system 70 controls the release of fuel from the fuel supply. In a preferred embodiment as shown generally in FIG. 1, the fuel supply is compressed hydrocarbon gas and valve system 70 is a normally open valve, forced closed by the pressure of a spring member 74. In this embodiment, valve actuator 68 acts on valve system 70 to lift valve stem 76 upward to release the compressed hydrocarbon gas.

In another embodiment, a normally closed valve, forced closed by an internal spring can be used with a valve actuator which exerts an upward pressure on valve system 70 to open the valve.

To operate the lighter, the user first depresses thumb pad 62, which causes cam member 66 to engage valve actuator 68 to lift valve stem 76 to release fuel gas. The depression of thumb pad 62 compresses impact spring 30 until inner member comes into contact with the top of resistant spring 50. At or near this point, the user should exert additional force to overcome spring 50 in order to cause plexor 28 to be released from the retaining mechanism thereby allowing compressed spring 30 to drive plexor 28 against impact pad 26 and causing piezoelectric element 24 to produce a spark to ignite the released fuel to produce a flame. To extinguish the flame, the user simply releases thumb pad 62 thereby releasing valve actuator 68 allowing spring 74 to close valve system 70. Spring 16 returns the piezoelectric ignition mechanism 10 to its rest or normal configuration as shown in FIGS. 1, 2 and 3. The piezoelectric ignition mechanism of the present invention may also used with a natural gas oven range, an outdoor gas grill or similar devices to increase the degree of difficulty for operation and therefore its level of resistant to undesirable operation by children.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A piezoelectric ignition mechanism comprising:

a telescopic assembly having first and second members;

a return spring associated with the first and second members for biasing the first and second members away from each other;

a piezoelectric element positioned inside the telescopic assembly;

a plexor movably disposed in the telescopic assembly and is resiliently biased by an impact spring, said impact spring is supported at the other end by an end member of the telescopic assembly, said plexor is retained at a predetermined distance away from the piezoelectric element, such that when the plexor is released, it impacts against the piezoelectric element to produce a spark;

wherein the ignition mechanism further comprises a resistant spring disposed within the telescopic assembly, such that it resists the release of the plexor.

2. The piezoelectric ignition mechanism according to claim 1 wherein the piezoelectric element is disposed in the first member of the telescopic assembly, and wherein the plexor comprises at least one lug disposed on its side, said at least one lug is received by at least one longitudinal slot defined on the first member, so that the movement of the plexor is guided by said at least one longitudinal slot.

3. The piezoelectric ignition mechanism according to claim 2 wherein the first member further defines at least one notch connected to said at least one longitudinal slot, such that when the at least one lug is received in the at least one notch, the plexor is positioned at said predetermined distance from the piezoelectric element.

4. The piezoelectric ignition mechanism according to claim 3 wherein the second member defines at least one release ramp, so that when the first member is moved toward the second member, the at least one lug rides on the release ramp until the plexor is released from the at least one notch.

5. The piezoelectric ignition mechanism according to claim 4 wherein the resistant spring resists the release of the plexor from the at least one notch by resisting the movement of the first member toward the second member.

6. The piezoelectric ignition mechanism according to claim 5 wherein the resistant spring is disposed in the end member of the telescopic assembly.

7. The piezoelectric ignition mechanism according to claim 6 wherein a bottom of the first member comes into contact with the resistant spring and at least partially compresses same, before the plexor is released to impact the piezoelectric member.

8. The piezoelectric ignition mechanism according to claim 7 wherein an impact pad is positioned between the piezoelectric member and the plexor.

9. The piezoelectric ignition mechanism according to claim 5 wherein the end member defines a channel to receive the resistant spring.

10. The piezoelectric ignition mechanism according to claim 5 wherein an applied force, required to move the first member toward the second member and to release the plexor to impact an impact pad disposed between the plexor and the piezoelectric element to produce a spark, is increased during said movement to at least partially compress the resistant spring in order to release the plexor.

11. A piezoelectric ignition mechanism comprising:

a telescopic assembly having first and second members;

a return spring associated with the first and second members for biasing the first and second members away from each other;

a piezoelectric element positioned inside the telescopic assembly;

a plexor movably disposed in the telescopic assembly and is resiliently supported by an impact spring, said impact spring is supported at the other end by an end member of the telescopic assembly;

means for retaining the plexor at a predetermined distance away from the piezoelectric element and means for releasing the plexor such that after the plexor is released, it impacts against the piezoelectric element to produce a spark; and a resistant spring disposed within the telescopic assembly, such that it resists the release of the plexor.

12. The piezoelectric ignition mechanism according to claim 11 wherein the resistant spring is disposed in the end member of the telescopic assembly.

13. The piezoelectric ignition mechanism according to claim 12 wherein a bottom of the first member comes into contact with the resistant spring and at least partially compresses same, before the plexor is released to impact the piezoelectric member.

14. The piezoelectric ignition mechanism according to claim 13 wherein an impact pad is positioned between the piezoelectric member and the plexor.

15. The piezoelectric ignition mechanism according to claim 13 wherein the end member defines a channel to receive the resistant spring.

16. The piezoelectric ignition mechanism according to claim 13 wherein an applied force, required to move the first member toward the second member and to release the plexor to impact the piezoelectric element to produce a spark, is increased during said movement to at least partially compress the resistant spring in order to release the plexor.

17. A lighter comprising:

a lighter body containing a fuel reservoir having a valve for releasing fuel therefrom;

a valve actuator depressible to actuate said valve to release said fuel; and a piezoelectric ignition mechanism which comprises a telescopic assembly having first and second members normally separated by a return spring, a piezoelectric element positioned inside the telescopic assembly, a plexor movably disposed in the telescopic assembly and is resiliently supported by an impact spring, said impact spring is supported at the other end by an end member of the telescopic assembly;

said a piezoelectric ignition mechanism further comprises means for retaining the plexor at a predetermined distance away from the piezoelectric element, means for releasing the plexor such that after the plexor is released, it impacts against the piezoelectric element to produce a spark, and a resistant spring disposed within the telescopic assembly, such that it resists the release of the plexor.

18. The lighter according to claim 17 wherein a bottom of the first member of the piezoelectric ignition mechanism comes into contact with the resistant spring and at least partially compresses same, before the plexor is released to impact the piezoelectric member.

19. The lighter according to claim 18 wherein an applied force, required to move the first member toward the second member and to release the plexor to impact the piezoelectric element to produce a spark, is increased at a first rate during said movement before the first member contacts the resistant spring and at a second rate once the first member at least partially compresses the resistant spring.

20. The lighter according to claim 19 further comprises an anvil member and two electrodes, said electrodes define a gap therebetween such that the spark generated by the impact between the plexor and the piezoelectric element is conducted to the electrodes and discharged from one electrode to the other to ignite the released fuel.

21. The piezoelectric ignition mechanism according to claim 1, wherein the resistant spring is associated with the telescopic assembly such that the resistant spring is compressed by the first and second members after the first and second members have been moved towards each other by a distance that is insufficient to release the plexor.

* * * * *